US006346181B1

(12) United States Patent
Lee et al.

(10) Patent No.: US 6,346,181 B1
(45) Date of Patent: Feb. 12, 2002

(54) ELECTROPLATING PROCESS FOR PREPARING A NI LAYER OF BIAXIAL TEXTURE

(75) Inventors: Kyu Hwan Lee; Hyung-Sik Chung; Sang Ro Lee; Doyon Chang; Yongsoo Jeong; Jaimoo Yoo; Jae-Woong Ko; Hai-Doo Kim, all of Changwon-shi (KR)

(73) Assignee: Korea Institute of Machinery and Materials (KR)

( * ) Notice: Subject to any disclaimer, the term of this patent is extended or adjusted under 35 U.S.C. 154(b) by 0 days.

(21) Appl. No.: 09/571,821

(22) Filed: May 16, 2000

(30) Foreign Application Priority Data

Dec. 24, 1999 (KR) ..... 99-61762

(51) Int. Cl.[7] ..... C25D 5/00; C25D 5/18

(52) U.S. Cl. ..... 205/89; 205/103; 205/104; 205/227; 205/271

(58) Field of Search ..... 205/89, 90, 103, 205/104, 224, 227, 271

(56) References Cited

U.S. PATENT DOCUMENTS 4,244,788 A * 1/1981 Faulkner ..... 204/15
5,011,581 A * 4/1991 Omata ..... 204/38.4
5,763,108 A * 6/1998 Chang et al. ..... 428/694 R
6,150,034 A * 11/2000 Paranthaman et al. ..... 428/472
6,180,570 B1 * 1/2001 Goyal ..... 505/236
6,274,022 B1 * 8/2001 Asai et al. ..... 205/89

* cited by examiner

*Primary Examiner*—Kathryn Gorgos
*Assistant Examiner*—William T. Leader
(74) *Attorney, Agent, or Firm*—Cooper & Dunahm LLP

(57) ABSTRACT

Disclosed is an Ni-plated layer of biaxial texture, which is formed by electroplating. In the Ni-plated layer,peaks measured on a θ-rocking curve have a FWHM of 7° or less in terms of the misorientation on the c-axis; and peaks measured on ϕ-scan have a FWHM of 21° or less in terms of the misorientation on the plane formed by the a-axis and the b-axis. Also, a process of electroplating a Ni layer are disclosed. The process comprises forming a Ni-plated layer of biaxial texture under a magnetic field by electroplating and subjecting the Ni-plated layer to thermal treatment to develop the biaxial texture. This electroplating process is expected to give a significant contribution to the development of the electroplating technology and to replace the vacuum deposition used for the preparation of thin film magnetic materials or thin film piezoelectric materials.

6 Claims, 5 Drawing Sheets

ELECTROPLATING PROCESS FOR PREPARING A NI LAYER OF BIAXIAL TEXTURE

BACKGROUND OF THE INVENTION

1. Field of the Invention

The present invention relates to a Ni-plated layer with a biaxial texture, which is excellent in toughness and magnetic properties and useful as substrate for coating YBCO Super conductor cable. Also, the present invention is concerned with an electroplating process of and an apparatus for preparing the Ni-plated layer.

2. Description of the Prior Art

In a polycrystalline material, a texture refers to a single cluster structure consisting of a number of crystal particles which have the same crystal orientation in a polycrystalline material. The texture is generally divided into two groups: fiber texture and three-dimensional texture.

In order to better understand the background of the invention, a description will be given of the texture in conjunction with FIG. 1.

FIG. 1 schematically shows textures in board planks. FIG. 1*a* is a schematic view showing the absence of textures. Shown in FIG. 1*b* is a uni-axial texture, generically designated "fiber texture". The fiber texture is usually found in the columnar crystals of cast materials, vapor-deposited metal films, electroplated layers, extruded materials, and drawn wires. In the fiber texture, as seen in FIG. 1*b*, a uniform crystal orientation <hkl> appears in the c-axial direction of the material while crystal orientations are randomly arranged on the plane composed of the a-axis and the b-axis.

In contrast, the biaxial texture, which is exemplified in FIG. 1*c*, has the crystal orientation directed uniformly to the c-axis of the material as well as makes the crystal grains arranged uniformly in the direction of the a-axis and b-axis. Thus, the biaxial texture is composed of three-dimensionally uniform crystal orientations and crystal planes just like single crystals. This texture can be seen in rolled board planks.

A metal board of a biaxial texture exhibits characteristic physical properties. For instance, it is well known that, a biaxial texture is high in mechanical toughness because a small difference in direction angle between grain boundaries allows the biaxial texture to be of low interfacial energy. In addition, as in an Fe-6.5% Si alloy, the biaxial texture assures better characteristics in magnetic substances, ferroelectrics, and high critical temperature superconductors. Particularly, on the basis of the phenomenon that a coating layer tends to conform itself to the orientation of the substrate, a substance with a single crystal structure or a biaxial texture is used, for the most part, as a coating matrix so as to provide the coating layer with such a biaxial texture especially in the case that ferroelectrics of a perovskite structure, or YBCO high critical temperature superconductors are prepared by a thin film coating process. For instance, ORNL of the USA developed a so-called RABiTS process, which was a turning point in YBCO superconductor tape preparation. Taking advantage of the cubic crystal texturization phenomenon that the [001] axis is oriented vertically to the surface upon the recrystallization of cold-rolled FCC metal, the RABiTS process allows board planks with biaxial textures to be used as substrates in a subsequent thin film process. That is, after a rolled Ni board with a biaxial texture is prepared by rolling, a buffer layer and a YBCO superconducting thin film are coated on the Ni board by a vacuum deposition method. In this case, the coating grows into a biaxial texture as a result of conforming itself to the crystal orientation of the substrate having a biaxial texture. Removal of high angle crystal boundaries from the plane composed of the a-axis and the b-axis brings about a noticeable increase in the critical current density of superconduction. Therefore, a substrate with a biaxial texture has a technically very important significance.

A coating layer formed under a particular condition by electroplating is of a uniaxial texture because it shows a vertical orientation in the direction of the c-axis perpendicular to the matrix plane, but random orientations on the plane formed by the a-axis and the b-axis, as exemplified in FIG. 1*b*. Thus, it has been regarded as impossible to prepare a plated layer of biaxial texture in which crystal orientation is arranged uniformed in the direction of the c-axis as well as the a-axis and the b-axis. No research has been conducted on the preparation of plated layers which are of biaxial texture. If a biaxial texture had been realized by electroplating, it should have been possible to continuously produce tapes or boards of biaxial texture at lower costs with significantly greater ease compared with the rolling process which requires many rolling steps and intermediate thermal treatments.

There were some study cases that apply magnetic fields for plating processes. Most of them are directed to plating efficiency or deposition rates and few pertain to the orientation of plated layers.

J. McDonald found that micro-stresses became anisotropic within a coating which was deposited under a magnetic field, asserting that nickel coatings and iron-nickel alloy coatings, when being deposited at the lines of magnetic force parallel to the electrode, show anisotropy of micro stress and the orientation is dependent on the deposition condition of the magnetic field and the alloy composition. This resulted from the study on the uni-axial texture exhibiting vertical orientation, but was not extended to biaxial textures.

M. Perakh made an observation of that, under a magnetic field, iron, nickel and cobalt coatings were not affected in crystal orientation, but their surfaces abnormally grew in the direction of the lines of magnetic force to a rough state.

A. Chiba reported that the crystal orientation of a nickel coating changed depending on the magnetic field applied and became random at a magnetic field intensity of 0.6T in a watts bath. However, this is also confined to uni-axial textures.

The discordance among the researchers' results is, to the inventors' knowledge, attributed to the fact that their research was conducted under such a plating condition that account could not taken of only pure magnetic field effect or the intensity of magnetic field was too weak to provide magnetic field effects.

SUMMARY OF THE INVENTION

Therefore, it is an object of the present invention to overcome the above problems encountered in prior arts and to provide a Ni-electroplated layer which is of a biaxial texture such that it is superior in toughness and magnetic properties.

It is another object of the present invention to provide a process of preparing Ni layers of biaxial texture at a low cost by electroplating.

In accordance with an embodiment of the present invention, there is provided a process of preparing an Ni-plated layer, comprising the steps of: forming an Ni-plated layer of biaxial texture under a magnetic field by electroplating; and subjecting the Ni-plated layer to thermal treatment to enhance the biaxial texture.

In accordance with another embodiment of the present invention, there is provided an electroplating bath, capable of allowing the formation of a Ni-plated layer of biaxial texture, which comprises an anode and a cathode arranged therein and an electromagnet installed at its external side.

In accordance with a further embodiment of the present invention, there is provided an Ni-plated layer of biaxial texture, formed on a polycrystalline matrix, wherein peaks measured on a θ-rocking curve have a FWHM(Full Width at Half-Maximum) of 7° or less in terms of the misorientation on the c-axis and peaks measured on T-scan have a FWHM of 21° or less in terms of the misorientation on the plane formed by the a-axis and the b-axis.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
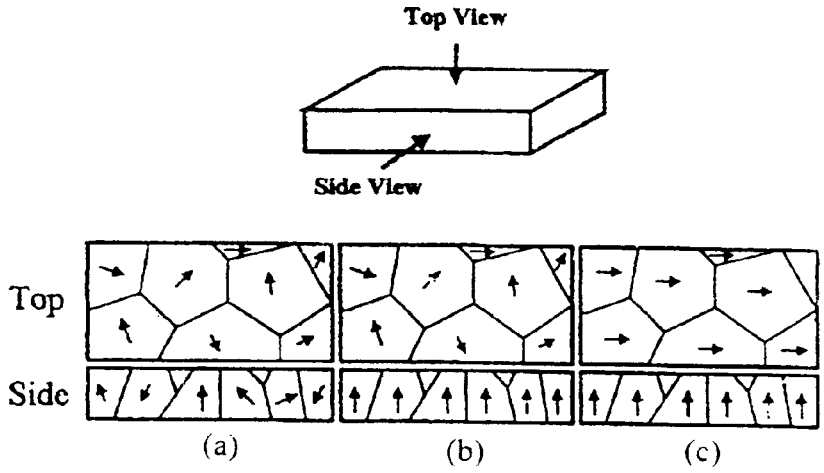
FIG. 1 schematically illustrates texture for randomly oriented crystals (a), for uniaxially oriented crystals (b) and biaxially oriented crystals (c)

In order to provide a biaxial texture for a substrate, it must have the (001) plane which is almost perfectly preference-oriented in the c-axis, vertical to the substrate itself. If such a uni-axial texture is absent, no biaxial textures appear in the substrate. As to the extent to which a uni-axial texture, a texture fraction (TF), which is represented by the following equation, is useful information.

$$\text{Texture Fraction } (TF) = \frac{I(khl)/I_0(hkl)}{\sum [I(hkl)/I_0(hkl)]}$$

wherein I(hkl) and $I_o$ (lhk) are integrated intensities of an experimental sample and a standard powder sample, respectively.

A TF of 0.95 or greater on the (001) plane guarantees an excellent biaxial texture (cubic crystal texture, (001) [001]) to form in a subsequent process. A sample, if all of its reflection planes are the same in TF, has disordered orientation. When a particular plane (hkl) of a sample has a TF greater than the average TF value of the other planes, the sample has a texture in which the [hkl] orientation of the crystal is vertical to the sample. The greater the texture fraction, the greater the extent of the texture. A TF of 1 means that a crystal plane is grown in the thickness direction in the entire sample. Therefore, if the TF(001) is 0.95 or greater, about 95% of the crystal plane on the (001) plane is vertically oriented to the matrix layer.

Given below is an explanation of a Ni plating solution and a plating condition which allows TF(001) to be 0.95 or greater.

In accordance with the present invention, a nickel plating solution comprises nickel sulfate at an amount of 150–400 g/l, nickel chloride at an amount of 20–80 g/l, and boric acid at an amount of 20–80 g/l.

The nickel plating solution preferably ranges, in pH, from 1.5 to 5 and most preferably from 2 to 3.5 in terms of (001) preferred orientation. An allowable temperature of the nickel plating solution falls within the range of 40 to 80° C., but the most preferable effect on the (001) preferred orientation is obtained in the range of 50 to 70° C. The electrodeposited layer preferably has a thickness of 20 to 300 μm. In the present invention, not only single-crystal but also polycrystalline metal plates, such as steel, copper, SUS, titanium, hastelloy, Inconel, etc., can be used as substrates for the electroplating. It was found that neither material composition nor crystal orientation of the substrates have influence on the orientation of the electrodeposited layer thereon.

For the electroplating, a direct current (DC) method, a pulse current (PL) method, and a periodic reverse current (PR) are all effective.

As for the plating conditions, they are dependent on the electroplating method used and given in Table 1, below.

TABLE 1

| Conditions | DC | PULSE | PR |
|---|---|---|---|
| ($A/dm^2$) | 3–15 | 3–20 | 3–20 |
| (T1) | — | 1 msec–100 msec | 1 msec–100 msec |
| (T2) | — | 1 msec–100 msec | 1 msec–100 msec |
| Duty (T1/T2) | — | 1/1–1/50 | 1/1–1/50 |

note:
PL: T1: a period of time for which a cathodic current flows,
T2: a down time
RR: T1: a period of time for which a cathodic current flows
T2: a period of time for which an anodic current flows Under the plating condition, the electroplated Ni layer has a uni-axial texture in which the (001) plane grows vertically to the substrate. Upon electroplating, application of a suitable magnetic field develops a cubic crystal texture represented by (001) [100], leading the plated layer to a biaxial texture.

In order to apply a magnetic field to a substrate, an electromagnet whose pole is at least twice to five times as large in area as the cathode, is required to be installed outside the plating bath. The reason why such a large magnetic pole is required is that a uniform texture can be realized in the plated layer on every surface of the substrate which is under the influence of a uniform magnetic field.

Preferably, the preferable intensity of the magnetic field applied falls within the range of 0.1 to 1 T. For example, if the intensity of the magnetic field is below 0.1 T, it is too weak to affect the motion of Ni ions in the plating solution. In result, no changes can be found in the texture of the plated layer, compared with that of the plated layer under no magnetic fields. To generate a magnetic field of greater than 1 T, a very large lead-in current is required. However, such a large current generates heat which may be of large enough energy to burn the coils. Hence, to generate a magnetic field at an intensity of more than 1 T is unfavorable in terms of economy and practice.

Figure 2:
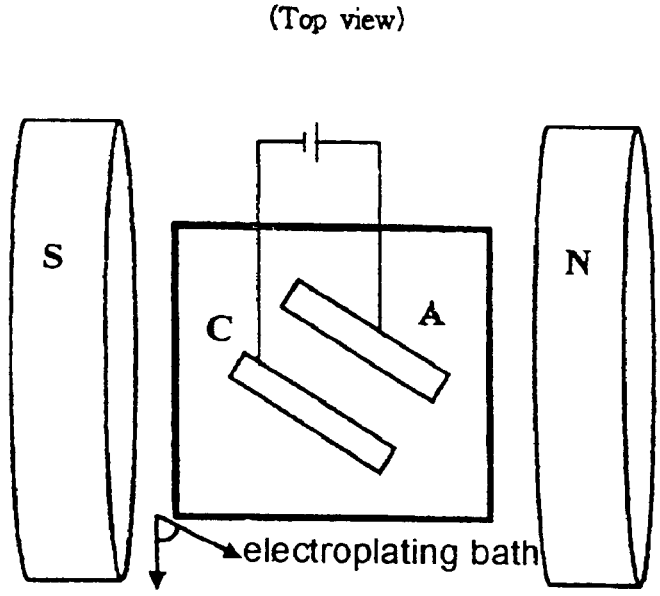
FIG. 2 is a schematic view showing the arrangement of electrodes and magnetic poles for the application of a magnetic field to an electroplating bath.
Figure 3:
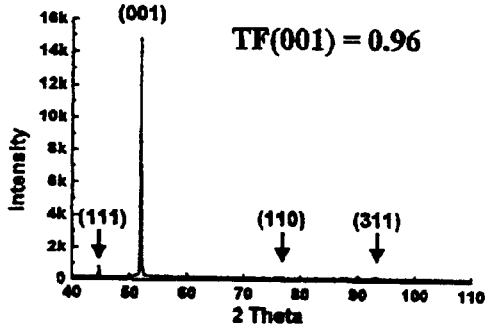
FIG. 3 is an XRD pattern (θ-2θ scan) of a Ni-electrodeposited layer in which (001) plane predominantly grows in the vertical direction to a substrate.
Figure 4:
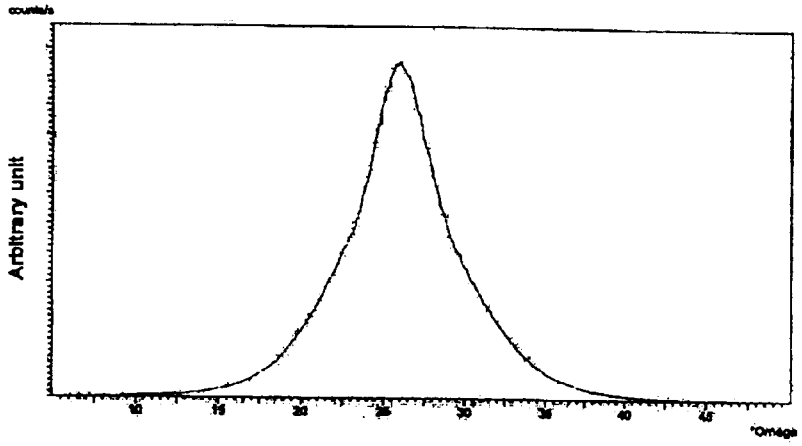
FIG. 4 is an XRD pattern (θ-rocking curve) of a (001) Ni-electrodeposited layer of biaxial texture.
Figure 5:
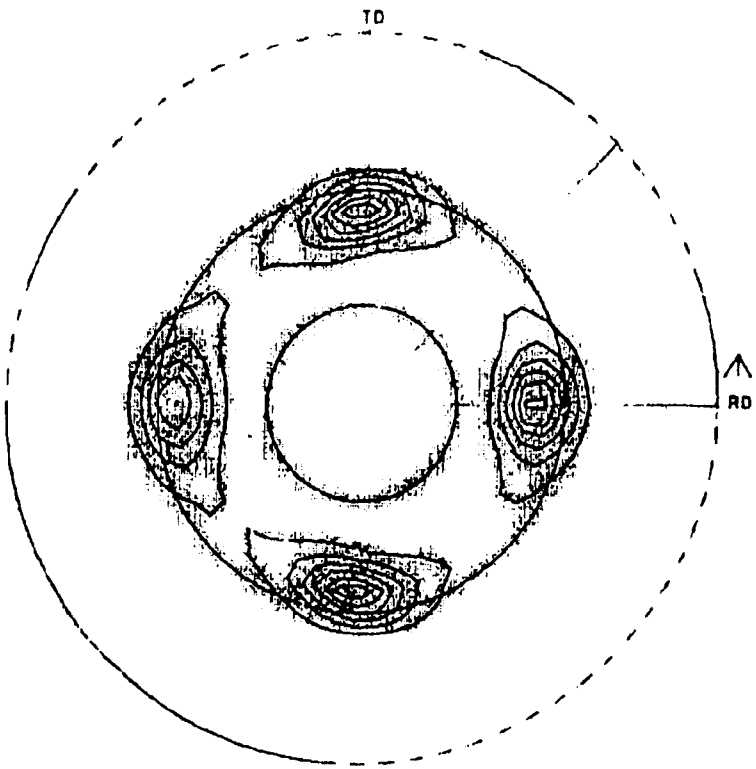
FIG. 5 is a (111) pole figure of a (001) Ni electrodeposited layer of biaxial texture.
Figure 6:
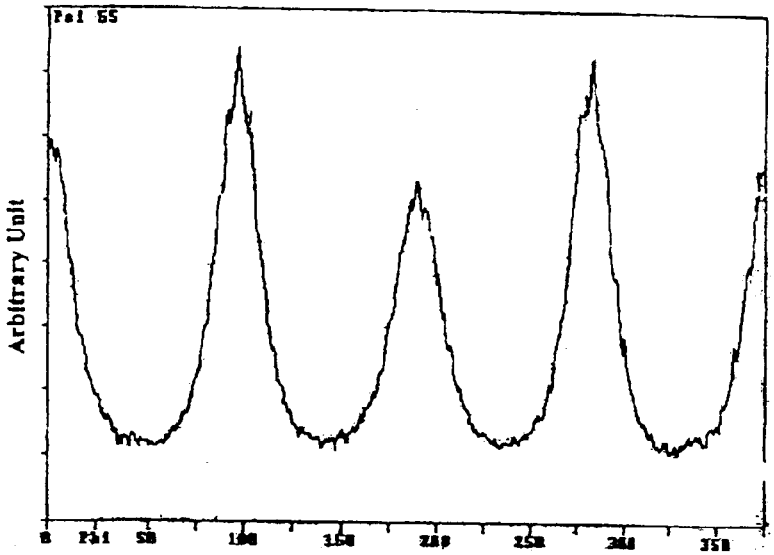
FIG. 6 is an XRD pattern (ϕ-scan) of a (001) Ni-electrodeposited layer of biaxial texture.

With reference to FIG. 2, there is an arrangement of the electrodes conducting electrodeposition in a magnetic field.

The arrangement of the electromagnet's poles and the cathode and anode has a critical influence on the formation of a biaxial texture. To form a biaxial texture in the electrodeposited layer, the angle between the electromagnet's poles and the cathode is changed in the range of 0 to 90° depending on the current density and the intensity of the magnetic field applied.

When a magnetic field is applied to a plating bath, the Ni ions in the plating solution are under the influence of the Lorenz force represented by the following equation:

$$F=q(E+v\times B)$$

wherein F is a Lorenz force, q is an electric charge of ion, v is a velocity vector of ion, and B is a magnetic field vector.

For instance, when a plating solution is only under an electric field, the ions of the solution move only toward the direction of the electric field. Where a magnetic field is further applied to the plating solution which is under an electric field, the motion of the ions is bent toward the magnetic field direction by the Lorenz force. This Lorenz force is believed to cause the provision of an orientation to the crystal structure of the Ni plated.

Generally, when being thermally treated at the temperature which allows constituent metals to re-crystallize, an FCC metal board which is rolled to a sufficient processing extent is endowed with a recrystallized texture. In particular, a cube texture appears in highly pure Cu or Ni. In the state that energy is stored as an orienting stress form by cold rolling, the thermal treatment at, for example, 1,000 ° C. makes constituent metals recrystallize while the stored energy gives contribution to the arrangement of the [100] axis of the new crystal grains in the direction vertical to the surface.

Likewise, when an Ni plated layer which is formed under such a magnetic field as to provide a biaxial texture as a cube texture, is subjected to a thermal treatment, the cube texture is further developed. The thermal treatment is preferably conducted at a temperature of 400 to 1,200° C. for a period of 10 min to 10 hours in a hydrogen, nitrogen or argon atmosphere. For example, if the thermal treatment is conducted at lower than 400° C., the driving force for the diffusion of atoms is too small to cause a change in the texture of the plated layer. Or, the atoms diffuse at too low speeds to gain economical profits. On the other hand, at more than 1,400° C., the Ni plated layer suffers from being seriously softened, so its mechanical strength becomes poor to the extent that it cannot sustain its own weight. Thus, to carry out the thermal treatment at more than 1,400° C. is practically useless. As for the period of time necessary to transform the layer into a sufficiently recrystallized texture, it is lengthened at low temperatures and shortened at high temperatures.

The development of biaxial textures in this manner is, to the inventors' knowledge, attributed to the following reasons. The electroplated layer originally has no orientation to the substrate, but has a tensile or compressive stress generated therein. This internal stress is converted into an orienting stress form by the Lorenz force generated by the magnetic field applied at an angle.

A better understanding of the present invention may be obtained in light of the following examples which are set forth to illustrate, but are not to be construed to limit the present invention.

EXAMPLE

Using the electroplating process described above, Ni-plated layers were formed on various substrates under the conditions indicated in Table 2 and then, subjected to heat treatment according to the indications of Table 2, below. The Ni-plated layers, which thus had biaxial textures, were analyzed and the results are given in Table 2.

TABLE 2

| | Ni Plating | | | | | | | | | | | | | |
|---|---|---|---|---|---|---|---|---|---|---|---|---|---|---|
| | Plating Sol'n | | | | | | Avg. Current | Mag. Field | Angle between pole & | Thermal Treat. | | | Results FWHM | |
| substrate | $NiSO_4$ | NiCl | Boric Acid | Temp. (° C.) | Thick. (μm) | Type | Density ($A/dm^2$) | intensity (T) | cathode (°) | Temp. (° C.) | Time (hrs) | TF | θ-rocking curve | ϕ-scan |
| Cu | 200 | 15 | 15 | 70 | 60 | DC | 5 | 0.2 | 45 | 800 | 1 | 0.96 | 6.37° | 21° |
| SUS304 | 280 | 30 | 30 | 50 | 100 | DC | 5 | 0.8 | 30 | 400 | 8 | 0.96 | 6.1° | 18.0° |
| Steel | 300 | 50 | 50 | 80 | 80 | DC | 15 | 1.0 | 90 | 1000 | 1/6 | 0.97 | 6.5° | 17.5° |
| Ti | 380 | 60 | 50 | 40 | 150 | PL | 18<br>T1: 90 ms<br>T2: 10 ms | 0.3 | 90 | 900 | 1/2 | 0.98 | 5.8° | 16.2° |
| SUS316 | 240 | 20 | 45 | 15 | 50 | PL | 15<br>T1: 5 ms<br>T2: 5 ms | 0.8 | 0 | 1100 | 1/6 | 0.99 | 5.7° | 16.8° |
| Hastelloy | 250 | 20 | 25 | 50 | 150 | PL | 15<br>T1: 60 ms<br>T2: 40 ms | 0.4 | 30 | 700 | 2 | 0.99 | 5.7° | 15.0° |
| Cu | 400 | 60 | 40 | 70 | 100 | PR | 15<br>T1: 9 ms<br>T2: 1 ms | 0.1 | 45 | 800 | 3 | 0.99 | 5.7° | 14.2° |
| Inconel | 250 | 40 | 30 | 60 | 40 | PR | 10<br>T1: 50 ms<br>T2: 50 ms | 0.2 | 60 | 1200 | 1/6 | 0.99 | 5.5° | 14.0° |

TABLE 2-continued

| | Plating Sol'n | | | Ni Plating | | | | | | Thermal Treat. | | | Results FWHM | |
|---|---|---|---|---|---|---|---|---|---|---|---|---|---|---|
| substrate | $NiSO_4$ | NiCl | Boric Acid | Temp. (° C.) | Thick. (μm) | Type | Avg. Current Density ($A/dm^2$) | Mag. Field intensity (T) | Angle between pole & cathode (°) | Temp. (° C.) | Time (hrs) | TF | θ-rocking curve | ϕ-scan |
| Hastelloy | 300 | 50 | 45 | 80 | 130 | PR | 8<br>T1: 80 ms<br>T2: 20 ms | 0.5 | 135 | 800 | 2 | 0.99 | 6.2° | 15.1° |
| Cu | 350 | 45 | 30 | 70 | 30 | PR | 20<br>T1: 80 ms<br>T2: 10 ms | 0.5 | 120 | 1400 | 1/6 | 0.99 | 5.4° | 16.0° |

As apparent from the data of Table 2, all of the samples tested were 0.96 or greater in TF and their FWHMs were 6.37° or smaller in terms of θ-rocking curve and 21° or smaller in terms of ϕ-scan. Therefore, the Ni-plated layer prepared according to the present invention is of excellent biaxial texture.

As described hereinbefore, the present invention provides an electroplating process by which a Ni-plated layer of biaxial texture can be formed on various substrates. Thus, the present invention allows YBCO superconducting cables to be used as substrates for which vacuum deposition can be applied. In addition, the electroplating process of the invention has an advantage over the conventional RABiTS process in production cost, equipment cost, and production rate. Further, the texture can be controlled by the electroplating process of the invention. Thus, giving a significant contribution to the development of the electroplating technology, the present invention is expected to replace the vacuum deposition used for the preparation of thin film magnetic materials or thin film piezoelectric materials.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A process of preparing an Ni-plated layer, comprising the steps of:

forming an Ni-plated layer of biaxial texture under a magnetic field by electroplating; and subjecting the Ni-plated layer to thermal treatment to enhance the biaxial texture.

2. A process as set forth in claim 1, wherein the electroplating is conducted in an electroplating bath at an external side of which an electromagnet is installed, said electroplating bath containing an anode and a cathode therein.

3. A process as set forth in claim 1, wherein the electroplating is conducted in a direct current plating method, a pulse plating method or a periodic reverse plating method, using a nickel plating solution which is maintained at 40–80° C. with pH 1.5–5 and comprises nickel sulfate at an amount of 150–400 g/l, nickel chloride at an amount of 20–80 g/l, and boric acid at an amount of 20–80 g/l.

4. A process as set forth in claim 3, wherein the electroplating is conducted at a cathode current density of direct current 3–15 $A/dm^2$ for the direct current plating method, at a current density of 3–20 $A/dm^2$ under the condition that a cathodic current on-time and a off time are each set at 1–100 msec for the pulse electroplating method, or at a cathodic current density of direct current 3–20$A/dm^2$ and at an anodic current density of 0.1–1.5 $A/dm^2$ under the condition that an anode current on-time and a cathodic current on-time are each set at 1–100 msec for the periodic reverse electroplating method.

5. A process as set forth in claim 1, wherein the magnetic field has an intensity of 0.1–1 T.

6. A process as set forth in claim 1, wherein the thermal treatment is carried out at a temperature of 400–1,200° C. for a period of 10 min–10 hours in a hydrogen, nitrogen or argon gas atmosphere.

* * * * *